US006474641B1

(12) United States Patent
Kellock

(10) Patent No.: US 6,474,641 B1
(45) Date of Patent: Nov. 5, 2002

(54) CONTAINER WITH ASSOCIATED PUZZLE

(76) Inventor: Kimberly Kellock, 1350 E. Westleigh Rd., Lake Forest, IL (US) 60045

( * ) Notice: Subject to any disclaimer, the term of this patent is extended or adjusted under 35 U.S.C. 154(b) by 0 days.

(21) Appl. No.: 09/179,733

(22) Filed: Oct. 27, 1998

(51) Int. Cl.[7] ..... A63F 9/10; A63F 9/12

(52) U.S. Cl. ..... 273/153 R; 273/157 R; 273/156

(58) Field of Search ..... 273/153 R, 156, 273/157 R; 206/579, 315.1, 457; 446/73, 75, 76; D21/478, 479, 480; D9/307, 310, 311, 316

(56) References Cited

U.S. PATENT DOCUMENTS

| | | | | | |
|---|---|---|---|---|---|
| D21,955 | S | | 11/1892 | Schwarz | |
| 2,144,751 | A | | 1/1939 | Brown | |
| 2,532,729 | A | * | 12/1950 | Millstein | 446/73 |
| 3,520,078 | A | * | 7/1970 | Klamer | 446/73 |
| 3,660,926 | A | | 5/1972 | Lerner et al. | |
| 3,767,203 | A | * | 10/1973 | Eaker | 206/315.1 X |
| 3,837,111 | A | * | 9/1974 | Godfrey et al. | 446/73 |
| 3,999,327 | A | * | 12/1976 | Immordino | 446/73 |
| 4,288,222 | A | * | 9/1981 | Kling | 446/73 X |
| D273,964 | S | * | 5/1984 | Roth | 273/157 R X |
| 4,815,607 | A | * | 3/1989 | Agapiou | 206/579 |
| 5,035,324 | A | * | 7/1991 | Bertrand | 206/457 |
| 5,123,846 | A | * | 6/1992 | Lewis | 273/157 R X |
| 5,165,689 | A | * | 11/1992 | Forsse et al. | 273/157 R |
| 5,249,802 | A | * | 10/1993 | McCarthy | 273/157 R |
| 5,386,909 | A | | 2/1995 | Spector | |
| 5,451,176 | A | | 9/1995 | Beltman | |
| 5,611,536 | A | | 3/1997 | Foreshew | |
| 5,615,883 | A | * | 4/1997 | Stevens | 273/157 R |

OTHER PUBLICATIONS

"Mixed Nuts Jigsaw", "Split Milk Jigsaw" Puzzles found in the Miles Kimball catalog, p. 103, Sep. 1983.*

* cited by examiner

*Primary Examiner*—Raleigh W. Chiu
(74) *Attorney, Agent, or Firm*—Patula& Associates P.C.

(57) ABSTRACT

The present invention is toy or educational tool comprising a container shaped and decorated to portray a doll or thing being studied and housing puzzle pieces inside that, when assembled, create an image of or thematically related to said container or thing being studied.

17 Claims, 2 Drawing Sheets

ASCORBIC ACID (VITAMIN C)

CONTAINER WITH ASSOCIATED PUZZLE

The present invention relates to a container and, more particularly, to a container which houses puzzle pieces related to said container.

BACKGROUND OF THE INVENTION

It is widely known that character based toys, such as dolls and action figures, are useful tools in the development of children. By playing with these items, children are able to create and understand relationships and interactions that become critical to their social development. Hence, dolls and action figures are well established in the prior art.

While teaching valuable lessons in social development, however, dolls and action figures function in a vacuum. Children who are limited only to these toys may not develop important analytical and motor skills. Moreover, the dolls and action figures require a child to imagine the setting and surrounding for such play. While imagination is critical to development, dolls do not teach children to synthesize their imaginations with the world with which they are familiar. The doll in an imaginative vacuum need never relate to any real and familiar time, place or function.

It is also widely known that puzzles are effective in developing improved cognitive and motor skills in children. They teach children to think spacially and place abstract concepts in a tangible medium. In short, they function at the opposite extreme from dolls.

U.S. Pat. No. 2,144,751 to Brown attempts to overcome the deficiency in the art by providing a figure toy container. In the Brown patent, a hollow cylindrical container forms the body of a toy and houses appendages, such as arms and legs, designed to fit and complete the toy figure. The toy cannot stand alone, however, without the inner pieces to complete the figure. Moreover, a child using the toy container of the Brown patent may improve his motor skills and analytical skills, but is not required to associate the doll with any real familiar time, place or function. Further, the Brown patent is unrelated to puzzles, pieces and particularly jigsaw puzzles.

U.S. Pat. No. 3,660,926 to Lerner et al. suffers from a similar deficiency as the Brown invention. In Lerner et al., the toy houses magnetic pieces which attach to the body of the toy. In the Lerner et al. patent, however, the pieces housed by the toy container are required to complete the toy so that the container is not a stand alone doll. Further, Lerner et al. patent is unrelated to puzzles, pieces and particularly jigsaw puzzles.

A need exists in the art for a toy that provides the social learning and imagination of a doll as well as the cognitive and concrete analysis of a puzzle. A need exists in the art for the combination of a doll that can operate in an analytical sphere and a puzzle that operates in a social one.

BRIEF SUMMARY OF THE INVENTION

It is an object of the present invention to provide a toy that is both an analytical and imaginative plaything. A further object of the invention is to provide an educational tool for children and students of all ages and abilities. A feature of the present invention is a doll having an internal cavity, said cavity housing puzzle pieces. Yet another feature of the invention is interlocking puzzle pieces that, when assembled, portray a two dimensional image of the doll in which they are housed. Yet another feature of the present invention is a container, shaped and decorated to portray a thing being studied. Another feature of the present invention is interlocking puzzle pieces that, when assembled, create an image thematically related to the doll or thing being studied in which they are housed. An advantage of the present invention is that a child or student is taught to spatially associate a two dimensional image of a completed puzzled with a tangible, three dimensional plaything. Another advantage of the present invention is that a child or student is taught to associate, and hence quickly recall the character of the doll or identity thing being studied with a thematically related function, time or place as created by the image in the puzzle.

Another object of the present invention is to provide a three dimensional toy that may stand alone or be used in conjunction with an associated puzzle. A feature of the present invention is container, shaped and decorated to portray a character, such as a doll or action figure. A further feature of the present invention is a means for accessing the internal cavity of the container. A further feature of the invention is a reversibly detachable head or torso or limb which will allow access to the container's internal cavity. An advantage of the present invention is that the container can function solely as a doll if desired. A further object of the invention is that the puzzle can be removed from the internal cavity of the container without permanently altering the container.

In brief, the present invention is a toy or educational tool comprising a container, said container shaped and decorated to portray a character or thing being studied and having an interior cavity; puzzle pieces housed in said interior cavity; and a means for accessing said interior cavity.

Numerous other objects, features and advantages of the present invention will become readily apparent through the detailed description of the preferred embodiment, the claims, and the accompanying drawings wherein like numerals are used to represent like parts throughout the same.

BRIEF DESCRIPTION OF THE DRAWINGS

A fuller understanding of the present invention can be had by reference to the accompanying drawings wherein.

DETAILED DESCRIPTION OF THE PREFERRED EMBODIMENT

Figure 1:
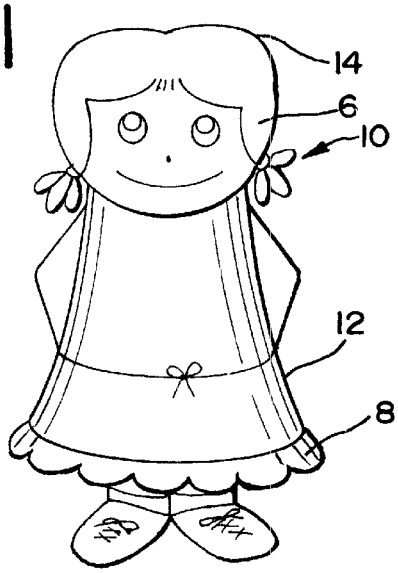
FIG. 1 is an elevated front view of one closed container of the present invention.

While the invention is susceptible of embodiment in many different forms, there is shown in the drawings and will be described herein in detail preferred and alternate embodiments of the present invention. It should be understood, however, that the present disclosure is to be considered an exemplification of the principles of the invention and is not intended to limit the spirit and scope of the invention and/or claims of the embodiment illustrated.

The present invention is a toy or educational tool comprising a container, said container shaped and decorated to portray a character or thing being studied and having an internal cavity; a means for accessing said internal cavity; and interlocking pieces of a puzzle housed in said container. FIG. 1 illustrates the present invention in a preferred embodiment. In FIG. 1, the toy, designated generally as numeral 10 is represented by a closed container 12 having a means for accessing the internal cavity (not shown) of said container. In FIG. 1, said accessing means is a reversibly detachable head 14. During play, the doll 10 would generally be used intact. The container 12 is shaped and decorated to portray a character, in this case a juvenile girl. Other suitable characters can be portrayed using different shapes and decoration of the container 12. For example, rather than decorating said container 12 with a dress 8 or pig tails 6, used to portray a young female, the container's shape or decoration could be modified to portray a juvenile boy, an animal, a cartoon character or any character, person, or animal, real or imagined, that a child may play with.

Figure 2:
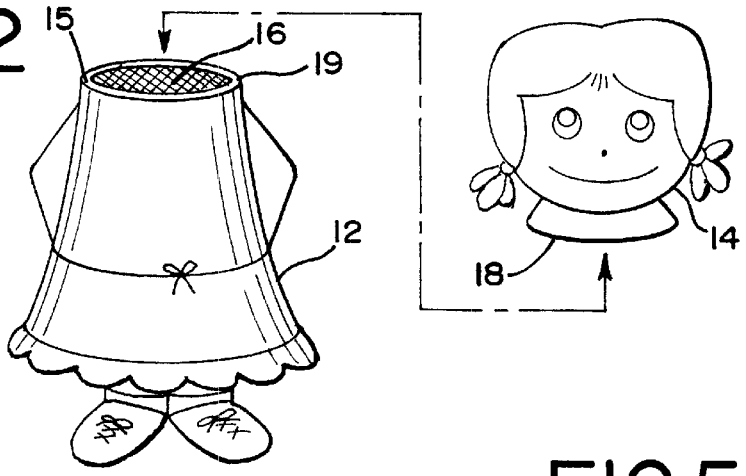
FIG. 2 is an elevated front view of a container and reversibly detached means for accessing the internal cavity of said container.

In FIG. 2, the container 12 opens via a reversibly detachable head 14, revealing an internal cavity 16 having an opening 15. Other suitable means for accessing the internal cavity 16 could be a reversibly detachable limb. Alternatively, the container 12 could open at any arbitrary point on said container 12, for example, a pivoting door or the like. The head 14, or other cavity accessing means, should be reversibly detachable so that the doll 10 is suitable for continual and repeated use. One means for effecting reversible detachment is a flange 18 circumscribing the base of the head 14, and another flange 19 circumscribing the edge of the opening 15. The flanges 18 and 19 should be of a flexible but durable material to lock the associated head 14 and container 12 in place as the base of the head 14 is inserted into the opening 15. A suitable material for the flanges 18 and 19 might be rubber or plastic. Another suitable means for effecting reversible attachment might be complementary threaded portions of the head 14 and container 12. Another suitable means for effecting reversible attachment might be a plurality of hook and loop fasteners arranged along the base of the head 14 and opening 15.

Figure 3:
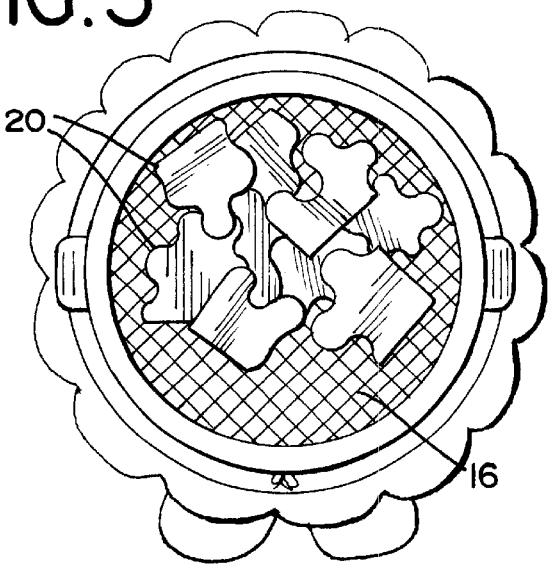
FIG. 3 is a top plan view of the internal cavity of a container of the present invention, with associated puzzle pieces.
Figure 5:
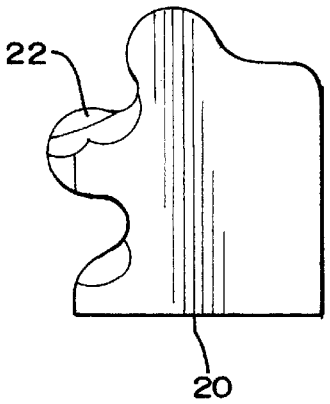
FIG. 5 is an elevated enlarged view of a puzzle piece of the present invention.

In FIG. 3, the container 12 is opened to reveal the internal cavity 16. The internal cavity 16 houses pieces of a two dimensional puzzle 20. It should be understood however that suitable puzzles may be enclosed, for example, the internal cavity 16 could also house pieces of a three dimensional puzzle or brain teasers. FIG. 5 illustrates a particular puzzle piece 20 having a portion of the image 22 created when said pieces are completely assembled.

Figure 6:
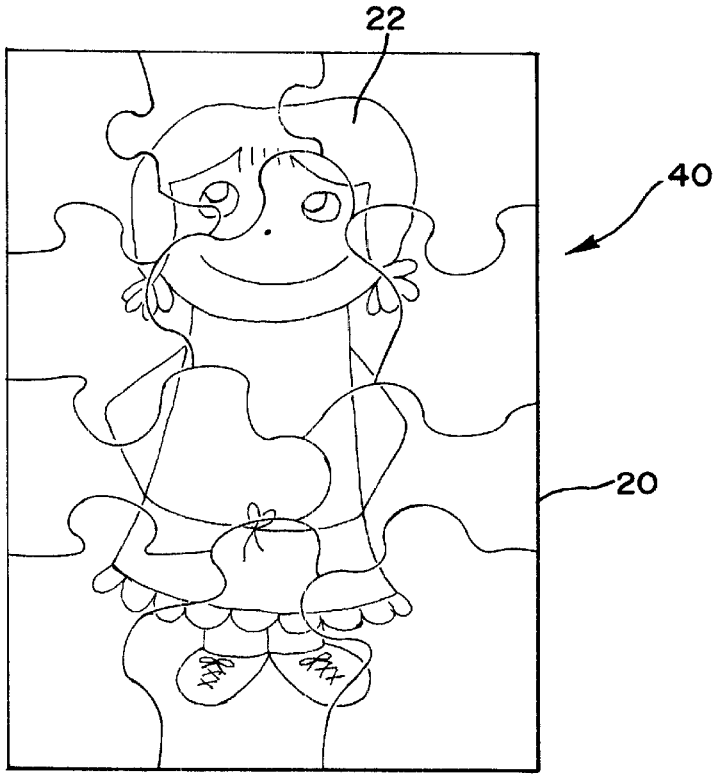
FIG. 6 is a top plan view of an assembled puzzle of the present invention.

The puzzle pieces 20 assemble to create an image, as in FIG. 6. In FIG. 6, the puzzle pieces 20 interlock to create a two dimensional image 22 of the toy 10 when assembled. The puzzle pieces 20 could be one sided, assembling to create a single perspective view of the doll 10, or two sided such that the completed puzzle creates a particular two dimensional perspective image of the doll 10 on one side and the reverse perspective image, i.e. front and back, on the other side. The completed image could also represent something thematically related to the doll 10. The puzzle is then used to teach a child to relate in space, time, and function the character of the particular doll. Hence, a doll portraying a baseball player may house puzzle pieces that assemble to form the image of a baseball diamond. Alternatively, a particular doll decorated in a unique cultural dress may house puzzle pieces that assemble to create a map of the doll's country of origin. A doll of a bird, for example, may house puzzle pieces that assemble to form the image of an egg, a nest, or other object thematically related to a bird.

The present invention could also serve as a unique gift to a child. For example, the container could be specially shaped and decorated to resemble the child to whom the doll is being given. The container would then house puzzle pieces that assemble to create the image of the child, the child's family, the child' pet, or any other image thematically related or identifiable to the child. The invention, however, need not be limited to just children, as the container could be specially shaped and decorated to resemble any human figure of any age group.

Figure 4:
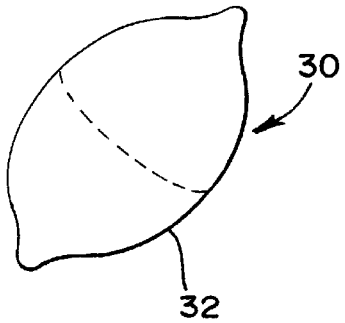
FIG. 4 is an elevated front view of an alternate embodiment of a closed container of the present invention.
Figure 7:
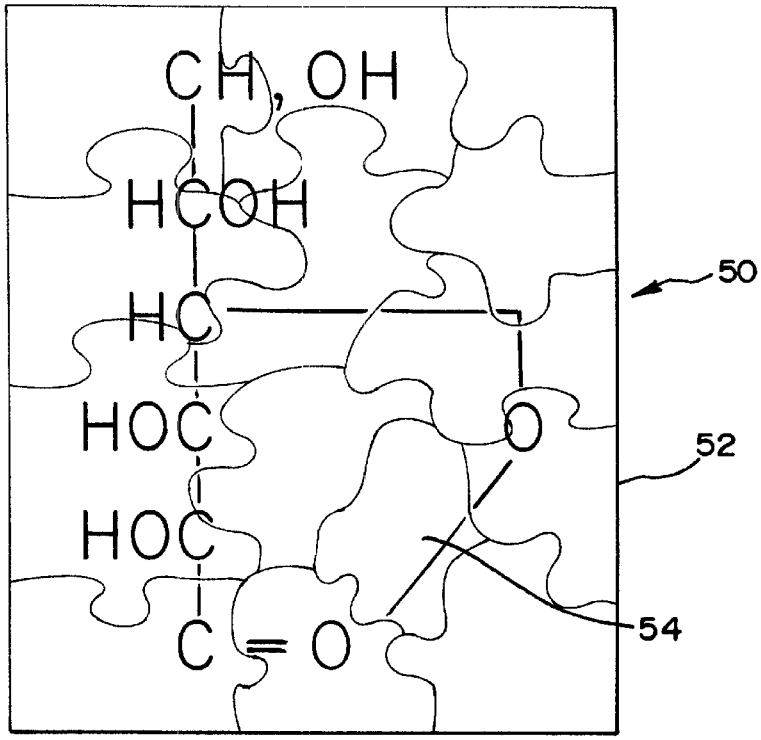
FIG. 7 is a top plan view of an alternate embodiment of an assembled puzzle of the present invention.

The present invention need not necessarily relate to children. A student of organic chemistry may find the present invention an effective educational tool. A student required to memorize the chemical formula for vitamin C, or ascorbic acid, may benefit from a container shaped as a citrus fruit, such as a lemon as illustrated in FIG. 4 and designated generally as numeral 30. Said container 32, has a means for accessing its internal cavity. The container 32 could screw open and shut at any arbitrary location or be held together by a plurality of hook and loop fasteners. Alternatively, said container 32 could have a plurality of snaps or latches to reversibly open and close said container 32. Referring to FIG. 7, said container could house puzzle pieces 52 that assemble to form a diagram 54 of the chemical formula for ascorbic acid. Hence a student may improve recall by associating the picture of the puzzle, vitamin C, with the container, a citrus fruit.

What is claimed is:

1. A method of learning using a combination puzzle and solution-suggesting container set, the combination puzzle and solution-suggesting container set comprising:

a container, said container shaped and decorated to portray a character and having an interior cavity, said container having a cover releasibly secured thereto, said container independently functioning as a character;

said container having a solution suggesting attribute for providing a clue as to how to solve puzzle;

a means for accessing said interior cavity of said container when said cover is removed; and jigsaw shaped puzzle pieces, said jigsaw shaped puzzle pieces defining a puzzle shape and portraying an image when assembled outside of said container, wherein said image resembles a two dimensional depiction of said container, said puzzle shape is unrelated to the shape of said interior cavity of said container, said jigsaw shaped puzzle pieces unbounded by said container when said pieces are assembled, said jigsaw shaped puzzle pieces housed in said interior cavity of said container when unassembled;

the method comprising the steps of:

removing said cover from said container;

removing said jigsaw shaped puzzle pieces from said container;

visually comparing said jigsaw shaped puzzle pieces with said container to determine said solution suggesting attribute; and assembling said jigsaw shaped puzzle pieces using said solution suggesting attribute whereby creating a finished, complete puzzle image and shape.

2. A method of learning using a combination puzzle and solution-suggesting container set, the combination puzzle and solution-suggesting container set comprising:

a container, said container shaped and decorated to portray a character and having an interior cavity, said container having a cover releasibly secured thereto, said container independently functioning as a character;

said container having a solution suggesting attribute for providing a clue as to how to solve puzzle;

a means for accessing said interior cavity of said container when said cover is removed; and jigsaw shaped puzzle pieces, said jigsaw shaped puzzle pieces defining a puzzle shape and portraying an image when assembled outside of said container, wherein said image resembles a three dimensional depiction of said container, said puzzle shape is unrelated to the shape of said interior cavity of said container, said jigsaw shaped puzzle pieces unbounded by said container when said pieces are assembled, said jigsaw shaped puzzle pieces housed in said interior cavity of said container when unassembled;

the method comprising the steps of:

removing said cover from said container;

removing said jigsaw shaped puzzle pieces from said container;

visually comparing said jigsaw shaped puzzle pieces with said container to determine said solution suggesting attribute; and assembling said jigsaw shaped puzzle pieces using said solution suggesting attribute whereby creating a finished, complete puzzle image and shape.

3. A method of producing an educational device comprising the steps of:

creating a container having an interior cavity and a cover detachably secured thereto, said container portraying an object;

creating an assembleable jigsaw puzzle, said puzzle having individual jigsaw shaped puzzle pieces, said pieces defining a puzzle shape and portraying an image when assembled outside of said container, said puzzle shape is unrelated to the shape of said interior cavity of said container, said puzzle pieces unbounded by said container when said pieces are assembled;

said container having a solution suggesting association between said image and said container to facilitate solution of said puzzle; and housing said jigsaw puzzle in said interior cavity of said container when unassembled, wherein said image resembles a two dimensional depiction of said container.

4. A method of producing an educational device comprising the steps of:

creating a container having an interior cavity and a cover detachably secured thereto, said container portraying an object;

creating an assembleable jigsaw puzzle, said puzzle having individual jigsaw shaped puzzle pieces, said pieces defining a puzzle shape and portraying an image when assembled outside of said container, said puzzle shape is unrelated to the shape of said interior cavity of said container, said puzzle pieces unbounded by said container when said pieces are assembled;

said container having a solution suggesting association between said image and said container to facilitate solution of said puzzle; and housing said jigsaw puzzle in said interior cavity of said container when unassembled, wherein said image resembles a three dimensional depiction of said container.

5. A method of producing a combination puzzle and solution-suggesting container set, comprising the steps of:

creating a container, said container having a shape and being decorated to portray a character and having an interior cavity, said container having a cover releasibly secured thereto, said container independently functioning as said character;

providing a means for accessing said interior cavity of said container when said cover is removed;

creating jigsaw shaped puzzle pieces, said jigsaw shaped puzzle pieces defining an assembled puzzle with a shape and portraying an image when assembled outside of said container, said image resembling a two or three dimensional depiction of said container, said puzzle shape being unrelated to the shape of said container, said jigsaw shaped puzzle pieces unbounded by said container when said pieces are assembled;

thematically relating said image to said container shape to facilitate assemblage of said jigsaw shaped puzzle pieces; and housing said jigsaw shaped puzzle pieces in said interior cavity of said container when unassembled.

6. A method of learning using a combination puzzle and solution-suggesting container set, comprising the steps of:

removing a cover from a container, said container shaped and decorated to portray a character and having an interior cavity, said container independently functioning as a character;

removing a jigsaw shaped puzzle pieces from said container, said jigsaw shaped puzzle pieces defining a puzzle shape and portraying an image when assembled outside of said container wherein said image resembles a two dimensional depiction of said container, said puzzle shape is unrelated to the shape of said interior cavity of said container, said jigsaw shaped puzzle pieces housed in said interior cavity of said container when unassembled;

visually comparing said jigsaw shaped puzzle pieces with said container to determine said solution suggesting attribute; and assembling said jigsaw shaped puzzle pieces using said solution suggesting attribute whereby creating a finished, complete puzzle, said jigsaw shaped puzzle pieces unbounded by said container when said pieces are assembled.

7. A method of learning using a combination puzzle and solution-suggesting container set, comprising the steps of:

removing a cover from a container, said container shaped and decorated to portray a character and having an interior cavity, said container independently functioning as a character;

removing a jigsaw shaped puzzle pieces from said container, said jigsaw shaped puzzle pieces defining a puzzle shape and portraying an image when assembled outside of said container wherein said image resembles a three dimensional depiction of said container, said puzzle shape is unrelated to the shape of said interior cavity of said container, said jigsaw shaped puzzle pieces housed in said interior cavity of said container when unassembled;

visually comparing said jigsaw shaped puzzle;pieces with said container to determine said solution suggesting attribute; and assembling said jigsaw shaped puzzle pieces using said solution suggesting attribute whereby creating a finished, complete puzzle, said jigsaw shaped puzzle pieces unbounded by said container when said pieces are assembled.

8. A method of learning using a combination puzzle and solution-suggesting container set, the combination puzzle and solution-suggesting container set comprising:

a container, said container shaped and decorated to portray a character and having an interior cavity, said container having a cover releasibly secured thereto, said container independently functioning as a character;

said container having a solution suggesting association between said image and said container to facilitate solution of said puzzle;

a means for accessing said interior cavity of said container when said cover is removed; and jigsaw shaped puzzle pieces, said jigsaw shaped puzzle pieces defining a puzzle shape and portraying an image when assembled outside of said container, wherein said image resembles a two dimensional depiction of said container, said puzzle shape is unrelated to the shape of said interior cavity of said container, said jigsaw shaped puzzle pieces unbounded by said container when said pieces are assembled, said jigsaw shaped puzzle pieces housed in said interior cavity of said container when unassembled;

the method comprising the steps of:

removing said cover from said container;

removing said jigsaw shaped puzzle pieces from said container;

visually comparing said jigsaw shaped puzzle pieces with said container to determine said solution suggesting attribute; and assembling said jigsaw shaped puzzle pieces using said solution suggesting attribute whereby creating a finished, complete puzzle image and shape.

9. A method of learning using a combination puzzle and solution-suggesting container set, the combination puzzle and solution-suggesting container set comprising:

a container, said container shaped and decorated to portray a character and having an interior cavity, said container having a cover releasibly secured thereto, said container independently functioning as a character;

said container having a solution suggesting association between said image and said container to facilitate solution of said puzzle;

a means for accessing said interior cavity of:said container when said cover is removed; and jigsaw shaped puzzle pieces, said jigsaw shaped puzzle pieces defining a puzzle shape and portraying an image when assembled outside of said container, wherein said image resembles a three dimensional depiction of said container, said puzzle shape is unrelated to the shape of said interior cavity of said container, said jigsaw shaped puzzle pieces unbounded by said container when said pieces are assembled, said jigsaw shaped puzzle pieces housed in said interior cavity of said container when unassembled;

the method comprising the steps of:

removing said cover from said container;

removing said jigsaw shaped puzzle pieces from said container;

visually comparing said jigsaw shaped puzzle pieces with said container to determine said solution suggesting attribute; and assembling said jigsaw shaped puzzle pieces using said solution suggesting attribute whereby creating a finished, complete puzzle image and shape.

10. A method of producing an educational device comprising the steps of:

creating a container having an interior cavity and a cover detachably secured thereto, said container portraying an object;

creating an assembleable jigsaw puzzle, said puzzle having individual jigsaw shaped puzzle pieces, said pieces defining a puzzle shape and portraying an image when assembled outside of said container, said puzzle shape is unrelated to the shape of said interior cavity of said container, said puzzle pieces unbounded by said container when said pieces are assembled; said container having a solution suggesting attribute for providing a clue as to how to solve the puzzle; and housing said jigsaw puzzle in said interior cavity of said container when unassembled, wherein said image resembles a two dimensional depiction of said container.

11. A method of producing an educational device comprising the steps of:

creating a container having an interior cavity and a cover detachably secured thereto, said container portraying an object;

creating an assembleable jigsaw puzzle, said puzzle having individual jigsaw shaped puzzle pieces, said pieces defining a puzzle shape and portraying an image when assembled outside of said container, said puzzle shape is unrelated to the shape of said interior cavity of said container, said puzzle pieces unbounded by said container when said pieces are assembled;

said container having a solution suggesting attribute for providing a clue as to how to solve the puzzle; and housing said jigsaw puzzle in said interior cavity of said container when unassembled, wherein said image resembles a three dimensional depiction of said container.

12. The method of claim 1, 2, 3, 4, 5, 6, 7, 8, 9, 10, or 11 wherein said container is shaped and decorated to portray a human figure.

13. The method of claim 1, 2, 3, 4, 5, 6, 7, 8, 9, 10, or 11 wherein said cover is a reversibly detachable head.

14. The method of claim 1, 2, 3, 4, 5, 6, 7, 8, 9, 10, or 11 wherein said container is shaped and decorated to portray an animal.

15. The method of claim 1, 2, 3, 4, 5, 6, 7, 8, 9, 10, or 11 wherein said container is shaped and decorated to portray a fictional character.

16. The method of claim 1, 2, 6, 7, 10, or 11 further comprising the steps of comparing said puzzle pieces to said container; determining said solution suggesting attribute; and applying said solution suggesting attribute to facilitate solution of the puzzle.

17. The method of claim 3, 4, 8, or 9 further comprising the steps of comparing said puzzle pieces to said container; determining said solution suggesting association; and applying said solution suggesting association to facilitate solution of the puzzle.

* * * * *